United States Patent [19]

Hoen et al.

[11] Patent Number: 4,746,151

[45] Date of Patent: May 24, 1988

[54] HALF-TURN INDUSTRIAL FASTENER

[75] Inventors: Cuyler Hoen, Rennesselaer; Frederick J. Pufpaff, Loudonville, both of N.Y.

[73] Assignee: Simmons Fastener Corporation, Albany, N.Y.

[21] Appl. No.: 35,225

[22] Filed: Apr. 6, 1987

Related U.S. Application Data

[63] Continuation of Ser. No. 764,943, Aug. 12, 1985, abandoned.

[51] Int. Cl.[4] ..... E05C 5/02

[52] U.S. Cl. ..... 292/111; 292/DIG. 31

[58] Field of Search ..... 292/111, 147, 152, 113, 292/DIG. 31

[56] References Cited

U.S. PATENT DOCUMENTS

| | | | |
|---|---|---|---|
| 758,333 | 4/1904 | Pfleghar | 292/147 X |
| 2,116,001 | 5/1938 | Schlage | 292/147 X |
| 2,820,995 | 1/1958 | Schlueter | 292/111 X |
| 2,853,752 | 9/1958 | Schlueter | 292/111 X |
| 4,090,727 | 5/1978 | Busch et al. | 292/111 |
| 4,560,190 | 12/1985 | Werner | 292/111 |

*Primary Examiner*—Richard E. Moore

*Attorney, Agent, or Firm*—Eliot S. Gerber

[57] ABSTRACT

A metal industrial fastener comprises a keeper plate having a hook-like keeper lip attached to one panel and a turn hasp member attached to another panel, which turn member may be recessed in a dish. The turn member has a spring which spring-loads a spring-back hook member, a base member fixed in a dish to a panel, a slide member which telescopically slides in the base member, and a turning means to rotate an eccentric rivet which cam-operates the slide member.

8 Claims, 3 Drawing Sheets

HALF-TURN INDUSTRIAL FASTENER

This application is a continuation of the prior application Ser. No. 764,943, filed Aug. 12, 1985, entitled "Half-Turn Industrial Fastener", now abandoned.

BACKGROUND OF THE INVENTION

The present invention relates to metal industrial fasteners and particularly to such fasteners which are used to pull together and secure two panels.

Industrial fasteners are commercially available to pull together and releasably lock two panels. For example, the turn member may be recessed in a dish and the two panels may meet in a butt joint. The panels, for example, may be the side and lid of a trunk, portable enclosure, packing case or instrument case. Such fasteners are usually formed from sheet metal and consist of two separated members, each one of which is attached to one of the panels. They may be used to obtain a tight seal by compressing a gasket positioned between the two panels.

One type of industrial fastener is shown in U.S. Pat. No. 2,853,752 to Ernest Schlueter, assigned to Simmons Fastener Corp. U.S. Pat. No. 2,820,995 to Ernest Schlueter describes a "spring loaded link lock fastener" in which a hasp member is mounted on a spring wire pivot. An eccentric pin 66 is integral with a bolt 60 and engages in a transverse slot 68. The bolt is a solid member. In U.S. Pat. No. 4,090,727 to Cuyler Hoen and Kiernan Busch, incorporated by reference herein, also assigned to Simmons Fastener, the solid bolt is replaced by a series of disks.

Although such presently available fasteners are satisfactory to fasten many types of containers, there has been a need for a suitable fastener which would operate with a spring-loaded spring-back hook member and may be mounted in a recessed dish in one panel and which would be rugged, operate under adverse environments, and which would not be expensive or complex.

SUMMARY OF THE INVENTION

The present invention provides an industrial fastener in two members. The first member is a conventional hook-like keeper plate (engagement latch) which is fastened to one panel, for example, the lid of a trunk. The second member is a turn member (an actuator) which is an assembly of parts (members) and may be fastened in a dish in another panel; for example, the panel carrying the dish may be a front wall of the container.

The turn member includes a slide member, a hook member, a spring, a base member, and a turning means. The turn member has a pivotable and spring-loaded hook member having at its end a hook-like lip portion. The lip of the hook member is removably engaged with the hook-like keeper lip portion of the keeper plate.

The turn member also includes a slide member having a transverse slot, the end of the slide member being pivotally connected to the hook member. The turning means is preferably a rotary member having wing handles which, when rotated a one-half turn (180°), will pull and lock the two panels together. Preferably the turn member comprises a number of parts, as explained in the above-mentioned U.S. Pat. No. 4,090,727, each of which may be formed from sheet metal, plated and heat-treated prior to assembly.

The base member provides a sleeve for the slide member which telescopically slides in the base and may be extended or withdrawn.

When the turning means is rotated, it turns a rivet which is offset and eccentric with respect to the center of turning movement and is within a transverse cam slot of the slide member. The rivet cams the slide member, either to extend or to withdraw the slide member. In one embodiment the turning means has fingers held in opposed indentations in a disk held between a spring steel disk and a third disk which rotates in a hole in the base member. The three disks are locked together by bosses and a rivet holds the base member, slide member and the three disks together.

BRIEF DESCRIPTION OF THE DRAWINGS

Features and objectives of the present invention will be apparent from the following detailed description of the invention which should be taken in conjunction with the accompanying drawings and which presents the inventors' best mode of carrying out the present invention.

In the drawings.

DETAILED DESCRIPTION OF THE INVENTION

Figure 1:
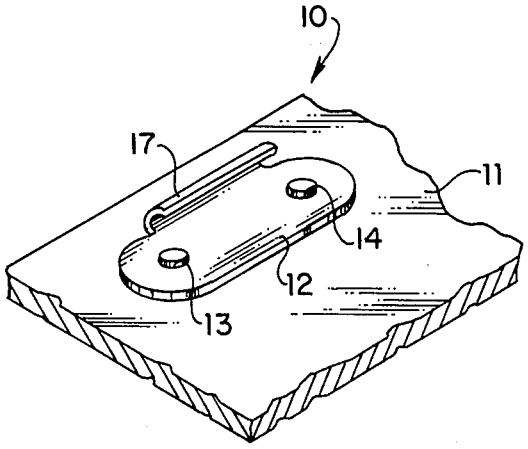
FIG. 1 is a perspective view of the keeper plate attached to a panel.

As shown in FIG. 1, the first panel 11 has fastened to it a hook-like keeper plate 10. For example, the panel 11 may be a portion of a lid of a trunk. The keeper plate 10 comprises a flat keeper plate portion 12 having two holes therethrough 13 and 14, and a curved turned-over hook-like keeper lip portion 17. The keeper plate 10 is attached to the panel by screws or other fastening devices inserted through the holes 13 and 14.

Figure 2:
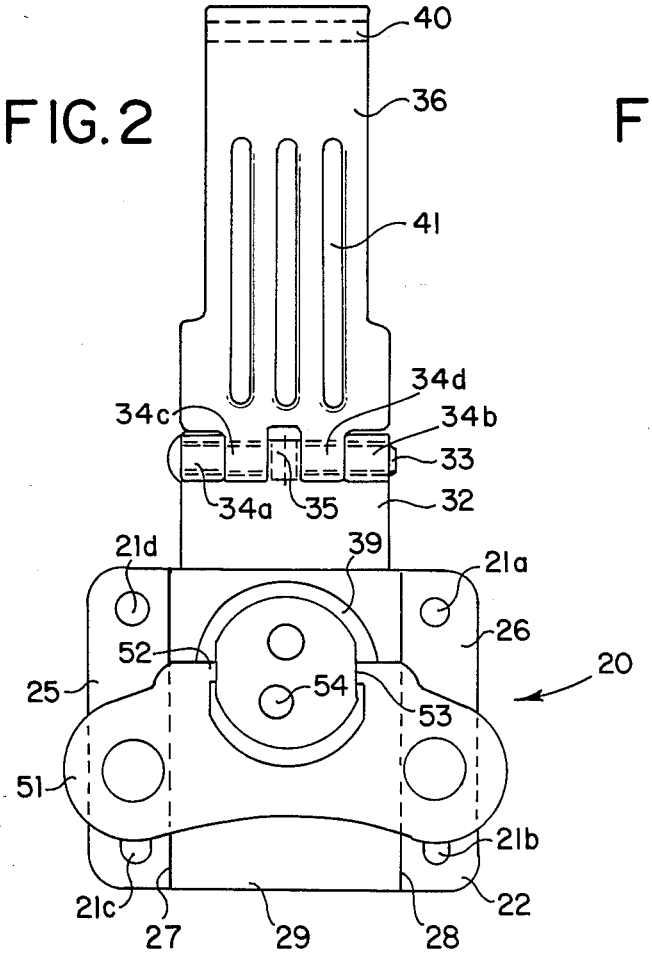
FIG. 2 is a top plan view of the turn member of the industrial fastener of the present invention.
Figure 4:
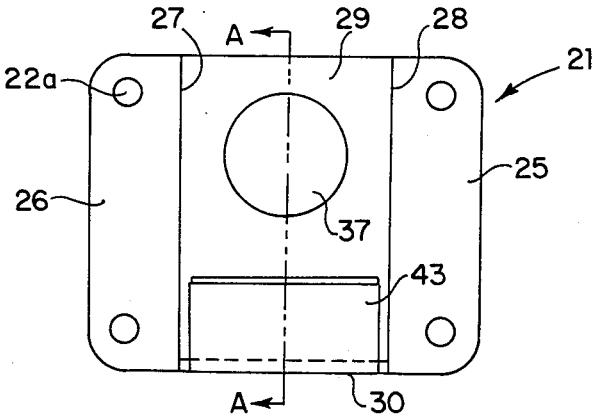
FIG. 4 is a bottom plan view of the base member.
Figure 5:
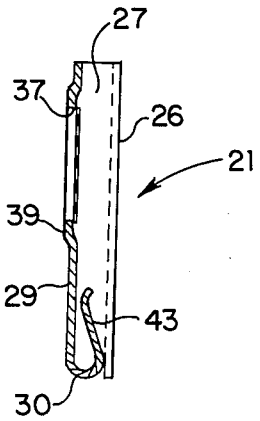
FIG. 5 is a cross-sectional view of the base member taken along line A—A of FIG. 4.

As shown in FIG. 2, the turn member 20 is adapted to be connected to a second panel or within a disk which is recessed in a second panel. For example, the second panel may be the front wall of a trunk. The turn member 20 includes a base member 21, which has opposed side flange portions 25,26 with four holes 21*a*–21*b* therethrough by which the base member 21 is fastened, for example, by rivets, to the panel or dish. The opposed side flange portions 25,26 are integral with their respective side wall portions 27,28, which are integral with the top wall portion 29. The top wall portion 29, at its end, has an integral turned-over portion 30 which forms a partial bottom wall portion 43, see FIGS. 4 and 5.

The turn member 20 further comprises a slide member 31 having as integral portions a central portion 42 and a turned-up portion 32. The slide member 31, at the end of its turned-up portion 32, has turned-over portions 34a,34b forming part of the tunnel for pin 33.

The hook member 36 has turned-over portions 34c,34d which also forms the tunnel for pin 33. A coil spring 35, mounted on pin 33, has one free arm urging the hook member upwards (as shown in FIG. 2, in the direction upwards away from the drawing). The other free arm of the coil spring is urged against the bottom face (not shown) of the turned-up portion 32. The pin 33, spring 35 and tunnel forms a spring-loaded hinge means. The coil spring 35 provides the spring snap-back action to pivot the hook member 36, when it is unlocked from the keeper plate 10, backward toward the second panel or into the recessed dish.

The hook member 36 is a sheet metal rectangular member having elongated reinforcement bumps 41. The free end of the hook member 36 is bent down to form hook-like lip portion 40. That lip portion 40 may be removably engaged with the lip portion 17 of the keeper plate.

The two opposed side wall portions 27,28 of the base member 21 provide a sleeve (guideway) for the slide member 31. The slide member 31 has a transverse slot 55 which is cam-operated by the shank of a rivet 54.

The rivet 54, which cams the slide member 31, is operated by, and is part of, the turning means 45 which is pivotally mounted on the base member 21. The base member 21 has a centered and raised boss porton 39 having a central opening 37 having an imaginary center.

The turning means may utilize a single solid disk, as in U.S. Pat. No. 2,853,752 or, preferably, a series of three stacked and interconnected disks as in U.S. Pat. No. 4,090,727, both patents being incorporated by reference herein. As shown in U.S. Pat. No. 4,090,727 the first (top) disk 56 is preferably a chrome-plated spring steel member having two holes; the second (middle) disk 57 has two side indentations, a hole and a boss on one side and a recess at the location of the boss at the other side; and the third (bottom) disk 58 has a hole and a boss which fits into the recess in the second (middle) disk. A rivet 54 passes through the holes in the disks and connects the disks and the slide member 21 together. The shank of the rivet 54 acts as an eccentric cam within the transverse slot 55 of the slide member 21. The disks and rivet 54 are parts of the turning means 45.

Figure 3:
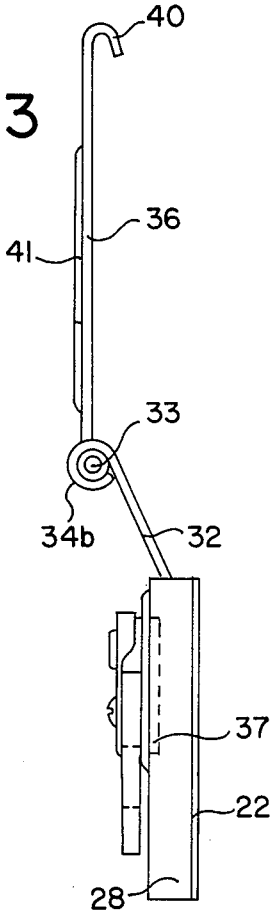
FIG. 3 is a side view of the fastener of FIG. 2.

The turning means 45 also includes a butterfly member 51, see FIG. 2, having wing handles. The wing handles have inwardly protruding and opposed fingers 52,53, which are square in cross-section and fit in the indentations of the second (middle) disk. The third (top) disk holds the wing handles in position by exerting spring pressure on the square fingers 52,53 to restore them either to a flat position, shown in FIGS. 2 and 3, or a raised position (not shown), which is 90° from the flat position.

It is an important feature of the present invention that the slide member 31 be guided in an exact slide path and that it be restrained with a certain pressure. The slide path is provided by the side wall portions 27,28 and the top wall portion 29 acting with the bottom wall portion 43. The bottom wall portion 43 has a spring action which causes it to be urged against the slide member 31 with a certain pressure, i.e., the slide member 31 is squeezed between the top wall portion 29 and the bottom wall portion 43 with a certain pressure. Such squeezing pressure provides a desirable resistive drag on the slide member 31 so that it moves with a more positive and exact movement.

In operation, starting with the slide member 31 in its extended position, the user rotates the hook member 36 against the force of the spring 35, on its hinge means, until the hook member lip portion 40 grips the lip portion 17 of the keeper plate 10. The user rotates the turning means 45 one-half turn (180°) clockwise, as viewed looking down in FIG. 2. The rivet 54 is rotated eccentrically clockwise about the imaginary center of the boss 39 and the three disks. The shank of the rivet 54 cams within the transverse slot 55 to slide the slide member 31 within the guideway of the base member. At the end of the one-half turn the slide member 31 is completely withdrawn. The operation is reversed to unlock the fastener.

The various members of the fastener are preferably stamped from sheet metal, formed into their proper shapes, and then plated and heat-treated after they are shaped. It will be noted that the various members may be completely formed, plated and heat-treated prior to assembly of the fastener.

Figure 6:
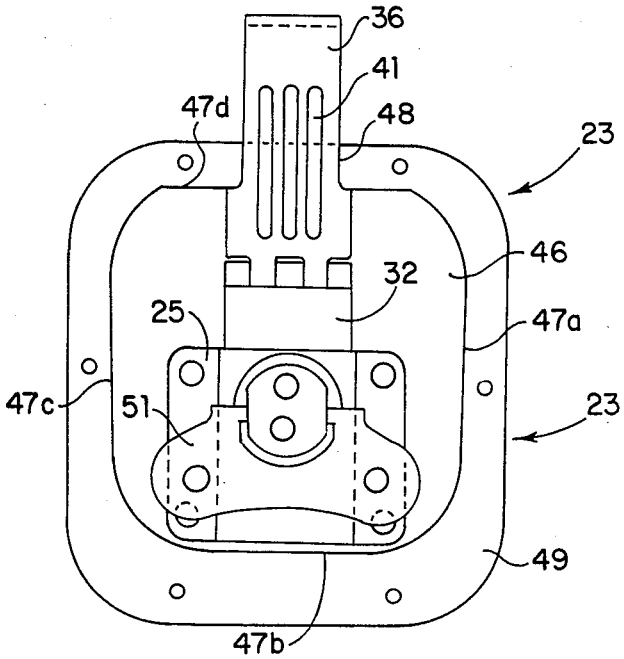
FIG. 6 is a top plan view of the fastener of the present invention in a recessed dish.
Figure 7:
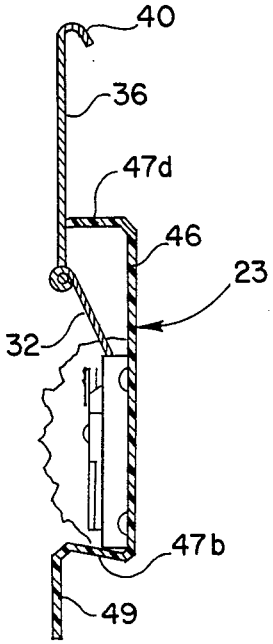
FIG. 7 is a side view, partly in cross-section, of the dish and fastener as shown in FIG. 6.
Figure 8:
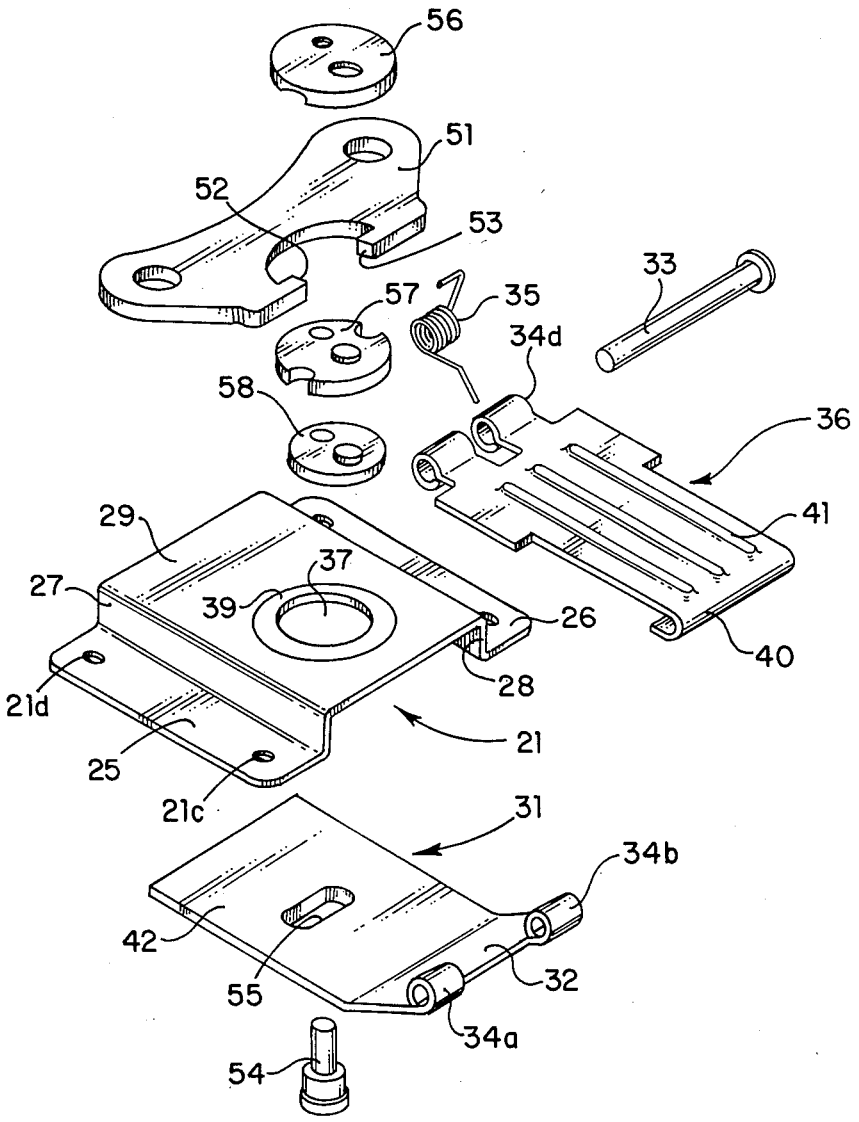
FIG. 8 is an exploded perspective view of certain parts of turn member.

Modifications may be made in the above-described embodiment within the scope of the invention and within the scope of the sub-joined claims. As shown in FIGS. 6 and 7, the fastener is recessed in a dish 23 having a bottom wall 46, four side walls **47*a*–47*d*, and a depression 48 in the front side wall 47*d* through which the hook member 36 extends. The dish has a flange 49 which extends around its circumference and is integral with the side walls 47*a*–47*d***. Alternatively, and not shown, the fastener may be mounted flat on a second panel.

What is claimed is:

1. An industrial fastener comprising a keeper plate member to be fastened to one panel and a turn member to be fastened to another panel;

said turn member comprising a base member, a slide member, a hook member, turning means and hinge means;

said hinge means pivotally connecting said hook member and said slide member and including a spring to pivotally spring-load said hook-member so that it tends to spring away from said keeper plate when said hook member is unlocked from said keeper plate;

said slide member being a sheet metal member having a flat portion which slides within said base member to be extended or withdrawn and has an elongated cam slot transverse to the direction of said movement;

said base member being a one-piece integral member having a top wall portion, a bottom wall portion and a bent-back U-connection portion which connects said top wall portion and said bottom wall portion, said bottom and top wall portions between them forming a guideway for said slide member and grasping said slide member with spring force to provide a restraining pressure on said slide member, said base member having two opposite elongated side wall portions perpendicular to said U-connection plate and in the same plane thereof, said sidewall portions forming a guideway for said slide member, said base member having at its top wall an opening therein;

said turning means protruding through said base member opening and including means to rotate said turning means and also including a cam member being eccentric as to the center of said turning means; wherein said turning means is rotated to move said cam member about the center of said base member opening and within said cam slot to thereby slide forward and withdraw said slide member and thereby grasp and pull together said keeper plate and said turn member.

2. An industrial fastener as in claim 1 wherein said hook member has a hook-like lip portion and said keeper plate has a hook-like lip portion, the two hook-like lip portions being removably connected.

3. An industrial fastener as in claim 1 wherein said hinge means comprises turned-back portions of said base member forming a tunnel therethrough, said hook member having a tunnel end portion, a pin through said tunnel portions and wherein said spring is a coil spring coiled about said pin.

4. An industrial fastener as in claim 1 wherein said turning means includes:

a first disk of sheet metal having a hole therethrough which fits within the opening in said base member and is rotatable therein;

a second disk member of sheet metal having opposed side indentations and a hole therethrough, and a third disk member of resilient steel having a hole therethrough, wherein said rivet protrudes through said disk holes.

5. An industral fastener comprising a keeper plate member to be fastened to one panel and a turn member to be fastened to another panel;

said turn member comprising a base member, a slide member, a hook member, turning means and hinge means;

said hinge means pivotally connecting said hook member and said slide member;

said slide member being a sheet metal member which slides within said base member to be extended or withdrawn and has an elongated cam slot transverse to the direction of said movement;

said base member being a one-piece integral member having a top wall portion, a bottom wall portion and a bent-back U-connection portion which connects said top wall portion and said bottom wall portion which said top and bottom walls between them forming a guideway for said slide member and grasping said slide member with spring pressure to provide a restraining pressure on said slide member, said base member having two oppsoite elongated side wall portions perpendicular to said U-connection portion and in the same plane thereof, said sidewall portions forming a guideway for said slide member, said base member having at its top wall an opening therein;

said turning means protruding through said base member opening and including means to rotate said turning means and also including a cam member which protrudes into said cam slot, said cam member being eccentric as to the center of said turning means;

wherein said turning means is rotated to move said cam member about the center of said base member opening and within said cam slot to thereby by slide forward and withdraw said slide member and thereby grasp and pull together said keeper plate and said turn member.

6. An industrial fastener as in claim 5 wherein said hook member has a hook-line lip portion and said keeper plate has a hook-like lip portion, the two hook-like lip portions being removably connected.

7. An industrial fastener as in claim 5 wherein said hinge means comprises turned-back portions of said base member forming a tunnel therethrough, said hook member having a tunnel end portion, and a pin through said tunnel portions and wherein said spring is a coil spring coiled about said pin.

8. An industrial fastener as in claim 5 wherein said turning means includes:

a first disk of sheet metal having a hole therethrough which fits within the opening in said base member and is rotatable therein, a second disk member of sheet metal having opposed side indentations and a hole therethrough, and a third disk member of resilient steel having a hole therethrough, wherein said rivet protrudes through said disk holes.

* * * * *